US008231122B2

(12) United States Patent
Tu

(10) Patent No.: US 8,231,122 B2
(45) Date of Patent: Jul. 31, 2012

(54) PAPER-STOPPING MECHANISM OF AUTOMATIC DOCUMENT FEEDER

(75) Inventor: Tung-Wen Tu, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 0 days.

(21) Appl. No.: 13/015,394

(22) Filed: Jan. 27, 2011

(65) Prior Publication Data

US 2012/0133095 A1 May 31, 2012

(30) Foreign Application Priority Data

Nov. 26, 2010 (TW) ..... 99140954 A

(51) Int. Cl.
*B65H 3/52* (2006.01)
*B65H 3/06* (2006.01)

(52) U.S. Cl. ..... 271/121; 271/117

(58) Field of Classification Search ..... 271/121, 271/167, 117
See application file for complete search history.

(56) References Cited

U.S. PATENT DOCUMENTS 6,431,541 B2 * 8/2002 Kuo et al. ..... 271/118
6,592,117 B2 * 7/2003 Kuo et al. ..... 271/10.01
6,991,227 B2 * 1/2006 Kim ..... 271/10.12
7,210,677 B2 * 5/2007 Fukumura et al. ..... 271/10.01
7,410,161 B2 * 8/2008 Yamamoto ..... 271/124
7,651,082 B2 * 1/2010 Hendrix et al. ..... 271/121
7,837,188 B2 * 11/2010 Lee et al. ..... 271/117
8,118,304 B1 * 2/2012 Chen et al. ..... 271/256
2003/0184000 A1 * 10/2003 Kim ..... 271/10.11
2007/0001374 A1 * 1/2007 Lee ..... 271/117
2008/0179817 A1 * 7/2008 Schalk et al. ..... 271/121

* cited by examiner

*Primary Examiner* — Kaitlin Joerger
*Assistant Examiner* — Patrick Cicchino
(74) *Attorney, Agent, or Firm* — Apex Juris, pllc; Tracy M. Heims

(57) ABSTRACT

A paper-stopping mechanism of an automatic document feeder is provided. The paper-stopping mechanism comprises an auxiliary gear, a traction member and a paper-stopping arm. As a paper pick-up arm of the automatic document feeder is moved upwardly or downwardly, the auxiliary gear is rotated in different directions. Upon rotation of the auxiliary gear, the auxiliary gear is engaged with a rack of the traction member to drive movement of the traction member. Consequently, a transverse rod of the traction member is sustained against the paper-stopping arm or raises the paper-stopping arm. When the transverse rod is sustained against the paper-stopping arm, the paper-stopping arm fails to be rotated in the paper-feeding direction, so that the function of stopping the paper is achieved.

7 Claims, 5 Drawing Sheets

PAPER-STOPPING MECHANISM OF AUTOMATIC DOCUMENT FEEDER

CROSS-REFERENCES TO RELATED APPLICATIONS

This non-provisional application claims priority under 35 U.S.C. §119(a) to Patent Application No(s). 099140954 filed in Taiwan, R.O.C. on Nov. 26, 2010, the entire contents of which are hereby incorporated by reference.

FIELD OF THE INVENTION

The present invention relates to a paper-stopping mechanism, and more particularly to a paper-stopping mechanism of an automatic document feeder.

BACKGROUND OF THE INVENTION

With increasing development of science and technology, a diversity of office machines such as copy machines, printers, scanners and fax machines have experienced great growth and are now rapidly gaining in popularity. The copy machines, the printers, the scanners and the fax machines are usually equipped with automatic document feeders (ADFs). The automatic document feeder utilizes a paper pick-up arm for successively feeding a stack of to-be-processed papers into the inner portion of the main body of the office machine, so that the papers can be further processed. For avoiding an erroneous printing or scanning operation of the office machine, during the process of automatically feeding the papers, every two consecutive papers fed into the automatic document feeder should be spaced from each other by a certain spacing interval. For preventing two or more papers from being simultaneously fed into the automatic document feeder, a paper-stopping slice is usually disposed at the inlet of a paper-feeding channel of the automatic document feeder. If any paper is improperly fed into the paper-feeding channel, the location of the paper will be erroneously judged during the paper-feeding process of the automatic document feeder. Under the circumstance, the subsequent process of scanning or printing the paper is adversely affected.

Moreover, during the process of feeding the paper into the automatic document feeder, the paper may be jammed in the paper-feeding channel. For removing the jammed paper from the paper-feeding channel, the paper pick-up arm for feeding paper is usually installed on a foldable upper cover. By uplifting the upper cover, the jammed paper can be removed from the paper-feeding channel.

FIGS. 1A and 1B schematically illustrate a paper-stopping mechanism of an automatic document feeder according to the prior art. The automatic document feeder comprises a paper pick-up arm 11. The paper-stopping mechanism 1 comprises a paper-stopping slice 10, a stopper 101 and a position-limiting structure 111. The paper-stopping slice 10 is pivotally coupled with an upper cover (not shown). The position-limiting structure 111 is disposed on a sidewall of the paper pick-up arm 11. If the automatic document feeder is not activated, the paper pick-up arm 11 is stayed in a standby position (see FIG. 1A). Due to the gravity force, the paper-stopping slice 10 is stayed in an initial position. Meanwhile, the position-limiting structure 111 is sustained against the stopper 101, so that the paper-stopping slice 10 fails to be rotated in the paper-feeding direction 12. Since the paper-stopping slice 10 fails to be rotated, the paper P is stopped by the paper-stopping slice 10 from being moved in the paper-feeding direction 12. On the other hand, when the paper pick-up arm 11 is moved downwardly to the paper pick-up position (see FIG. 1B), the position-limiting structure 111 is detached from the stopper 101, so that the paper-stopping slice 10 can be freely rotated in the paper-feeding direction 12. Consequently, the paper P may be smoothly fed into the paper-feeding channel by the paper pick-up arm 11 while pushing the paper-stopping slice 10.

The conventional paper-stopping mechanism, however, still has some drawbacks. For example, after a long use time of the automatic document feeder, the position-limiting structure 111 and the stopper 101 of the paper-stopping mechanism 1 are readily suffered from wear and deformation. Moreover, if a large amount of dust is accumulated on the position-limiting structure 111, the position-limiting structure 111 fails to be effectively sustained against the stopper 101. In addition, if the paper-stopping slice 10 fails to be naturally returned to the initial position, the paper-stopping efficacy is impaired.

Therefore, there is a need of providing a paper-stopping mechanism for stopping the paper in response to the action of a paper pick-up arm of the automatic document feeder.

SUMMARY OF THE INVENTION

The present invention provides a paper-stopping mechanism of an automatic document feeder with good paper-stopping efficacy.

In accordance with an aspect of the present invention, there is provided a paper-stopping mechanism of an automatic document feeder. The automatic document feeder has a paper pick-up arm for feeding a paper. The paper-stopping mechanism includes an upper cover, an auxiliary gear, a paper-stopping arm and a traction member. The paper pick-up arm is disposed on the upper cover. The auxiliary gear is disposed on the paper pick-up arm. During the paper pick-up arm is moved upwardly to a standby position, the auxiliary gear is rotated in a first direction. During the paper pick-up arm is moved downwardly to a paper pick-up position, the auxiliary gear is rotated in a second direction. The paper-stopping arm is pivotally coupled with the upper cover. The traction member is disposed on the upper cover. The traction member is stayed in a first position when the paper pick-up arm is in the standby position. The traction member includes a rack and a transverse rod. The rack is engaged with the auxiliary gear. Upon rotation of the auxiliary gear in the first direction, the traction member is moved to the first position. Whereas, upon rotation of the auxiliary gear in the second direction, the traction member is moved to a second position. When the traction member is in the first position, the transverse rod is sustained against the paper-stopping arm, so that the paper-stopping arm is stayed in a paper-stopping position. Whereas, when traction member is in the second position, the paper-stopping arm is raised by the transverse rod, so that the paper-stopping arm is detached from the paper-stopping position.

In an embodiment, the paper-stopping arm comprises an elongated slot and a paper-stopping slice. The transverse rod is penetrated through the elongated slot.

In an embodiment, the first direction is an anti-clockwise direction, and the second direction is a clockwise direction.

In an embodiment, the traction member is integrally formed.

In an embodiment, the auxiliary gear is penetrated through a sidewall of the paper pick-up arm, and engaged with a transmission gear of the paper pick-up arm.

In an embodiment, the traction member has a concave structure, and the paper pick-up arm has a convex structure corresponding to the concave structure.

In an embodiment, during the paper pick-up arm is moved upwardly to the standby position, the auxiliary gear is engaged with the rack to move the traction member to the first position, so that the concave structure is engaged with the convex structure and the paper pick-up arm is stayed in the standby position.

In an embodiment, during the paper pick-up arm is moved downwardly to the paper pick-up position, the traction member is driven by the auxiliary gear to be moved to the second position, so that the concave structure is detached from the convex structure and the paper pick-up arm is moved downwardly to the paper pick-up position.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
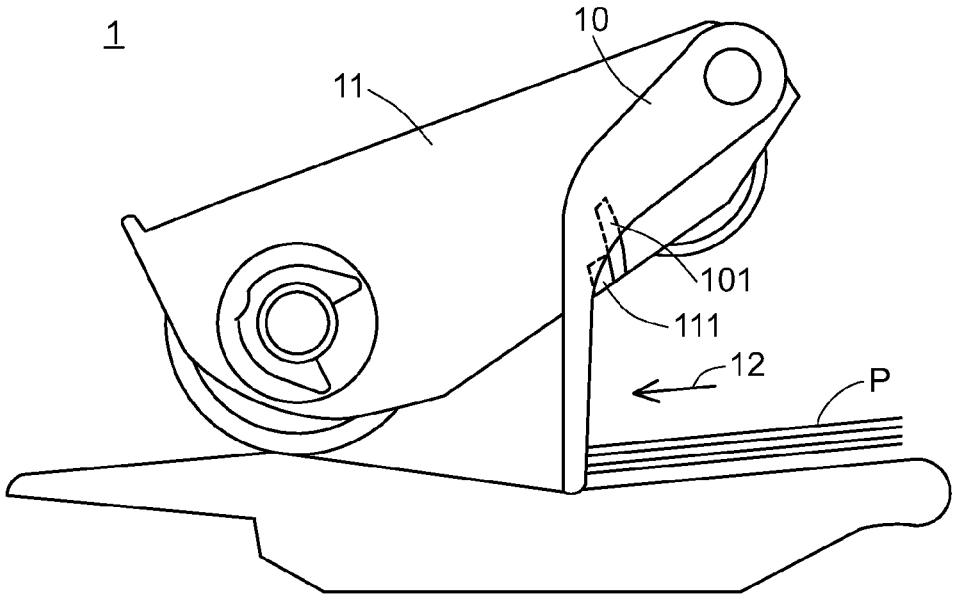
FIG.1A PRIOR ART
FIGS. 1A and 1B schematically illustrate a paper-stopping mechanism of an automatic document feeder according to the prior art.
Figure 1B:
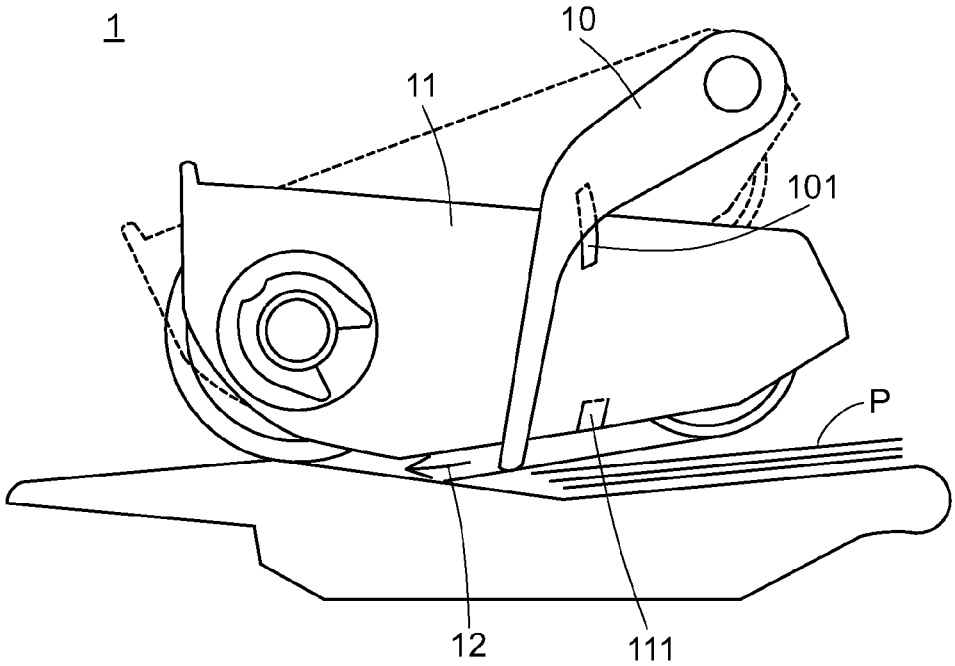
FIG.1B PRIOR ART
Figure 2:
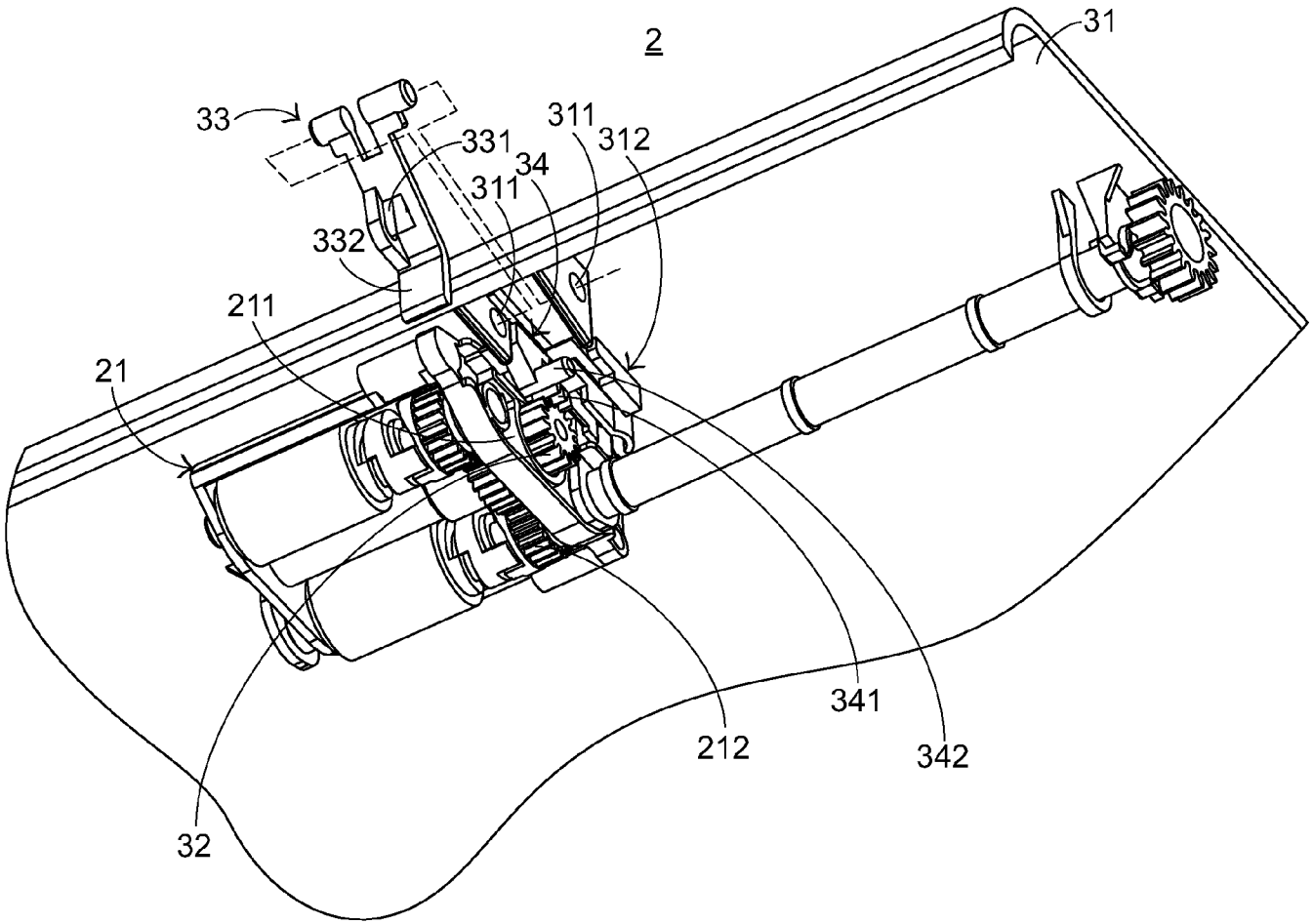
FIG. 2 is a schematic perspective view illustrating a paper-stopping mechanism of an automatic document feeder taken in a first viewpoint according to an embodiment of the present invention.

FIG. 2 is a schematic perspective view illustrating a paper-stopping mechanism of an automatic document feeder taken in a first viewpoint according to an embodiment of the present invention. As shown in FIG. 2, the automatic document feeder 2 comprises a paper pick-up arm 21. The paper pick-up arm 21 may be moved downwardly to a paper pick-up position. The paper-stopping mechanism comprises an upper cover 31, an auxiliary gear 32, a paper-stopping arm 33 and a traction member 34. The paper pick-up arm 21 is disposed on the upper cover 31. The auxiliary gear 32 is penetrated through a sidewall 211 of the paper pick-up arm 21, and engaged with a transmission gear 212 of the paper pick-up arm 21. During the paper pick-up arm 21 is moved downwardly to the paper pick-up position, the transmission gear 212 is rotated in an anti-clockwise direction, and thus the auxiliary gear 32 is correspondingly rotated in a clockwise direction. Whereas, during the paper pick-up arm 21 is moved upwardly to a standby position, the transmission gear 212 is rotated in the clockwise direction, and thus the auxiliary gear 32 is correspondingly rotated in the anti-clockwise direction.

The both ends of the paper-stopping arm 33 are inserted into corresponding pivotal holes 311 of the upper cover 31, so that the paper-stopping arm 33 is rotatable with respect to the upper cover 31. In addition, the paper-stopping arm 33 comprises an elongated slot 331 and a paper-stopping slice 332. The paper-stopping slice 332 is used for stopping papers. In this embodiment, the traction member 34 is integrally formed and disposed on the upper cover 31. Through a positioning block 312 of the upper cover 312, the traction member 34 is movable forwardly and backwardly with respect to the upper cover 31. The traction member 34 comprises a rack 341 and a transverse rod 342. The transverse rod 34 is penetrated through the elongated slot 331 of the paper-stopping arm 33. Moreover, a convex structure 213 is formed on the sidewall 211 of the paper pick-up arm 21, and the traction member 34 has a concave structure 343 corresponding to the convex structure 213 (see FIG. 4).

Figure 3A:
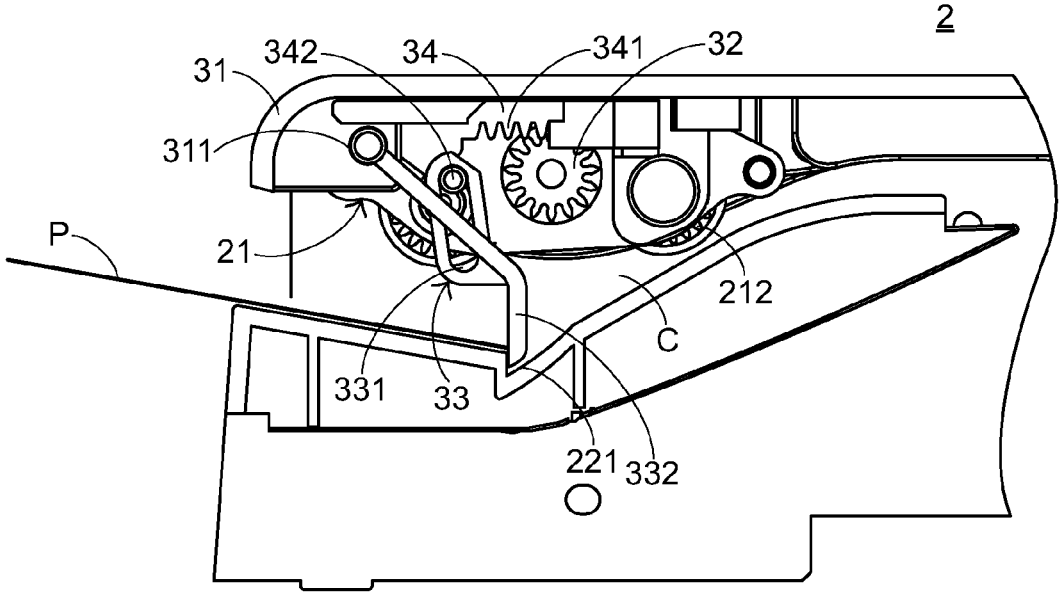
FIG. 3A is a schematic side view illustrating the paper-stopping mechanism of the automatic document feeder of FIG. 2, in which the paper pick-up arm is in a standby position.
Figure 3B:
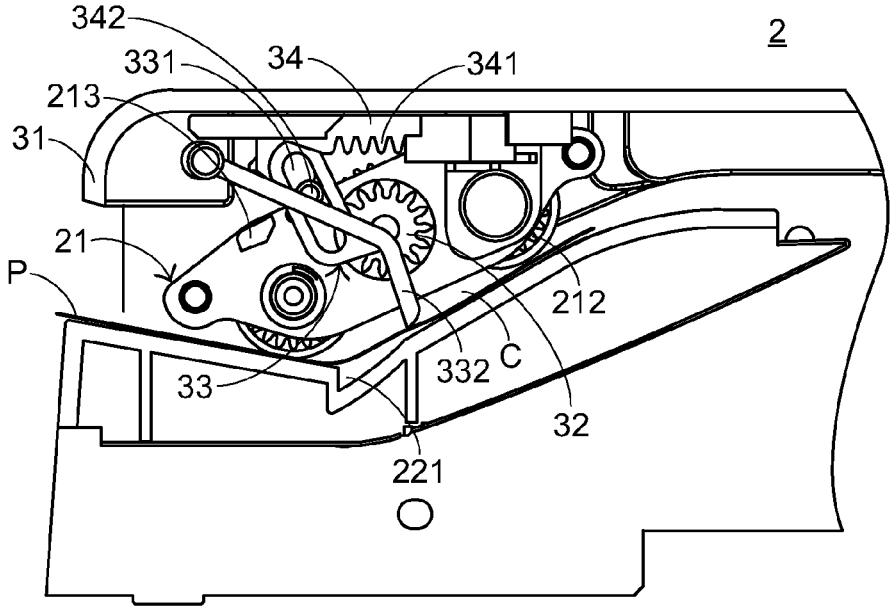
FIG. 3B is a schematic side view illustrating the paper-stopping mechanism of the automatic document feeder of FIG. 2, in which the paper pick-up arm is in a paper pick-up position.

Hereinafter, the operations of the paper-stopping mechanism will be illustrated in more details with reference to FIGS. 3A and 3B. FIG. 3A is a schematic side view illustrating the paper-stopping mechanism of the automatic document feeder of FIG. 2, in which the paper pick-up arm is in a standby position. FIG. 3B is a schematic side view illustrating the paper-stopping mechanism of the automatic document feeder of FIG. 2, in which the paper pick-up arm is in a paper pick-up position. As shown in FIG. 3A, after a paper pick-up action of the paper pick-up arm 21 is performed, the paper pick-up arm 21 is moved upwardly to the standby position. During the paper pick-up arm 21 is moved upwardly to the standby position, the auxiliary gear 32 is driven by the transmission gear 212 to be rotated in the anti-clockwise direction. Moreover, since the paper pick-up arm 21 is raised, the auxiliary gear 32 is engaged with the rack 341 of the traction member 34 to move the traction member 34 forwardly. At the same time, the transverse rod 342 of the traction member 34 is moved forwardly along the elongated slot 331 to be sustained against the paper-stopping arm 33, so that the paper-stopping arm 33 is stayed in a paper-stopping position. As shown in FIG. 3A, the paper-stopping slice 332 is accommodated within a recess 221 of a paper-feeding channel C to achieve a function of hindering the paper P from entering the paper-feeding channel C.

The process of moving the paper pick-up arm 21 downwardly to a paper pick-up position will be illustrated with reference to FIGS. 3A and 3B. Firstly, the auxiliary gear 32 is driven by the transmission gear 212 to be rotated in the clockwise direction. Meanwhile, since the rack 341 of the traction member 34 is still engaged with the auxiliary gear 32, the traction member 34 is driven by the auxiliary gear 32 to be moved backwardly. Then, the paper-stopping arm 33 is uplifted by the paper-stopping arm 33, so that the paper-stopping slice 332 is detached from the recess 221. Under this circumstance, the paper P fed by the paper pick-up arm 21 can be smoothly moved into paper-feeding channel C.

Figure 4:
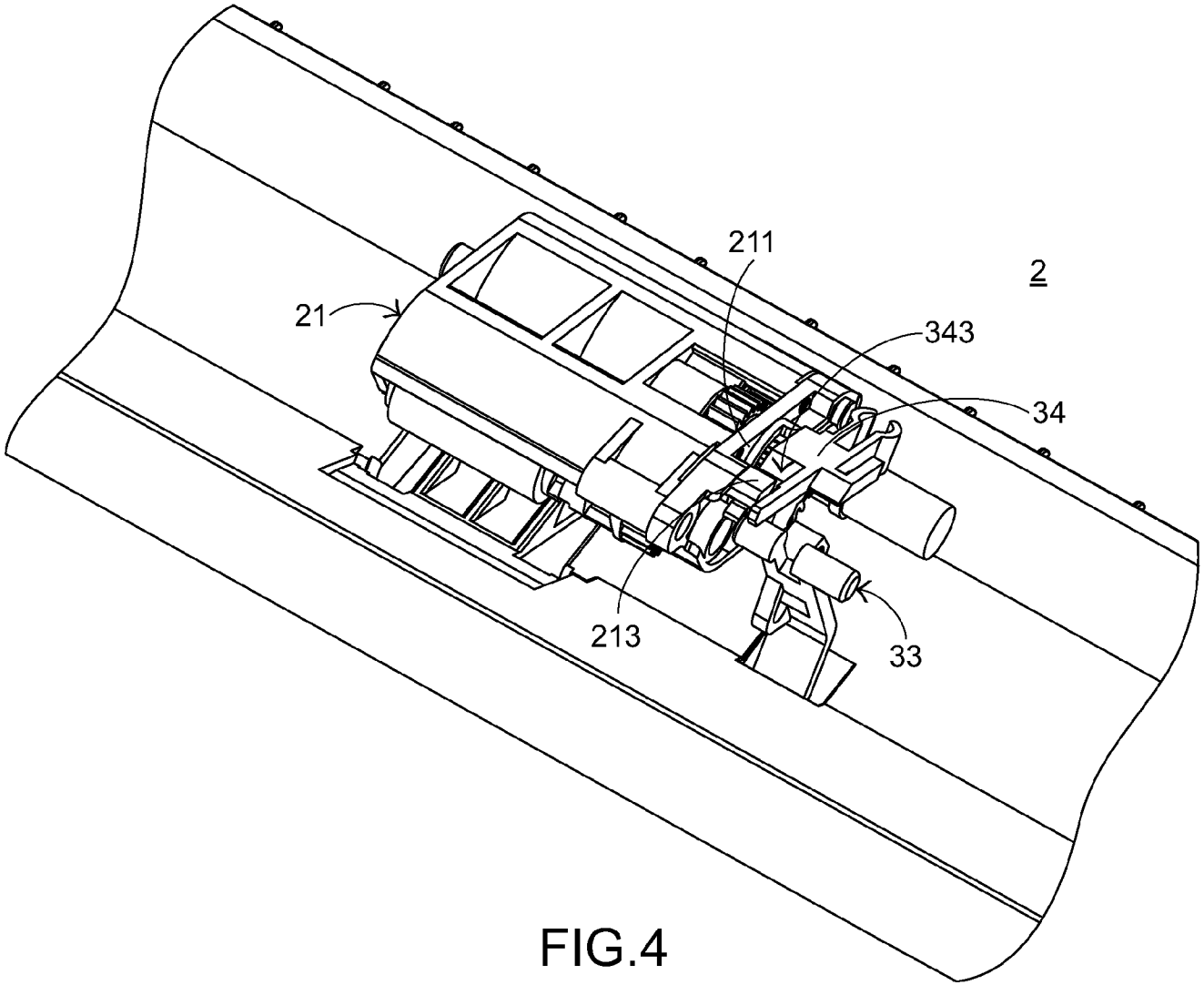
FIG. 4 is a schematic perspective view illustrating the paper-stopping mechanism of FIG. 2 and taken in another viewpoint, in which the paper pick-up arm is in the standby position.

FIG. 4 is a schematic perspective view illustrating the paper-stopping mechanism of FIG. 2 and taken in another viewpoint, in which the paper pick-up arm is in the standby position. Please refer to FIGS. 3A, 3B and 4. The convex structure 213 is formed on the sidewall 211 of the paper pick-up arm 21. Corresponding to the convex structure 213, the traction member 34 has a concave structure 343. After a paper pick-up action of the paper pick-up arm 21 is performed, the paper pick-up arm 21 is moved upwardly from the paper pick-up position to the standby position. During the paper pick-up arm 21 is moved upwardly from the paper pick-up position to the standby position, the auxiliary gear 32 is rotated in the anti-clockwise direction. Meanwhile, the auxiliary gear 32 is engaged with the rack 341 of the traction member 34 to move the traction member 34 forwardly. Consequently, the convex structure 213 of the sidewall 211 is engaged with the concave structure 343 of the traction member 34. Moreover, since the traction member 34 is disposed on the upper cover 31, the engagement between the convex structure 213 and the concave structure 343 may prevent the paper pick-up arm 21 from falling down but allow the paper pick-up arm 21 to be continuously stayed in the standby position. In such way, if the paper jam problem occurs and the upper cover is uplifted by the user to remove the jam paper, the paper pick-up arm 21 will not fall down to damage the office machine.

Figure 5:
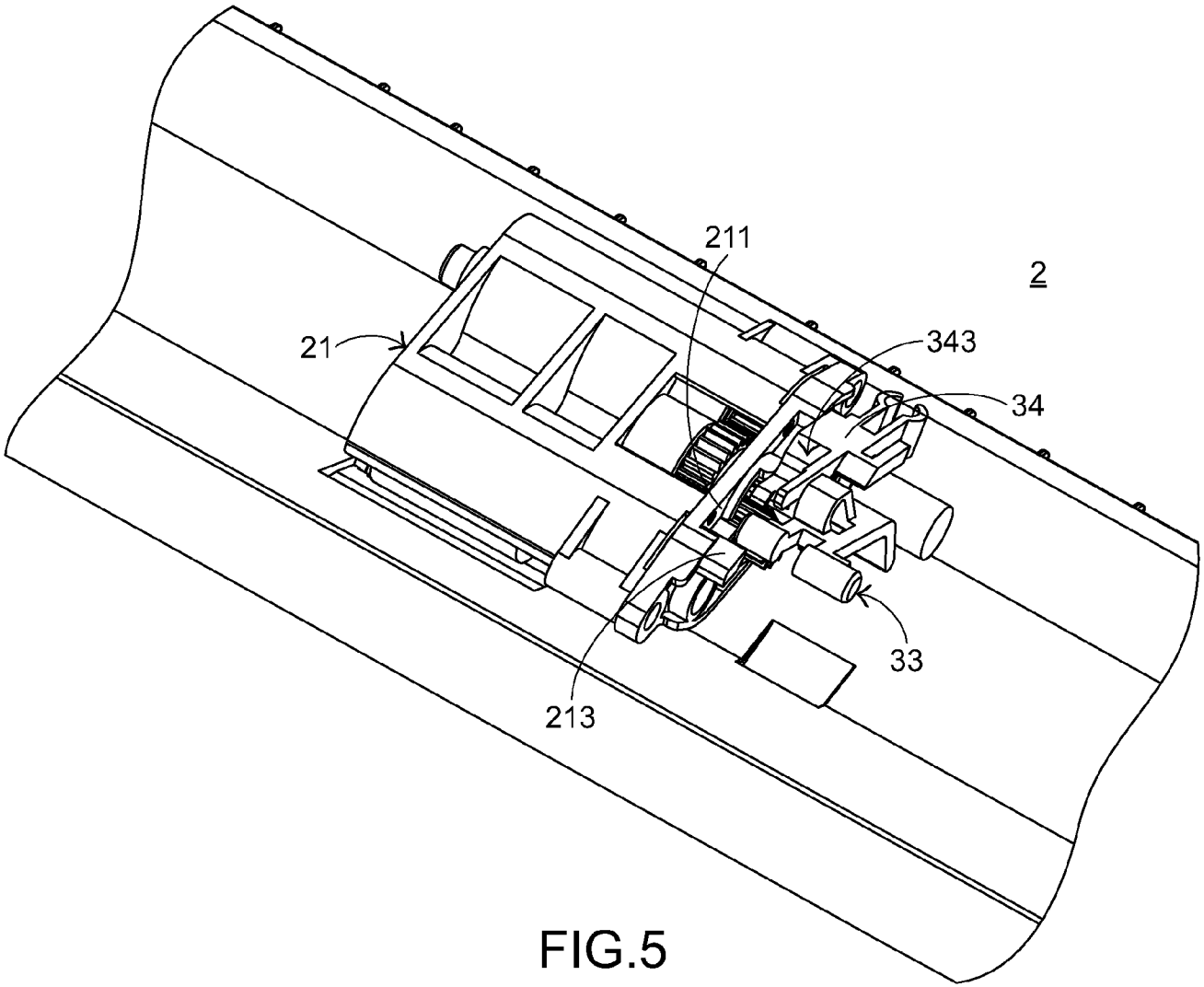
FIG. 5 is a schematic perspective view illustrating the paper-stopping mechanism of FIG. 2 and taken in another viewpoint, in which the paper pick-up arm is in the paper pick-up position.

FIG. 5 is a schematic perspective view illustrating the paper-stopping mechanism of FIG. 2 and taken in another viewpoint, in which the paper pick-up arm is in the paper pick-up position. Please refer to FIGS. 3A, 3B and 5. During the paper pick-up arm 21 is moved downwardly to the paper pick-up position, the auxiliary gear 32 is rotated in the clockwise direction, so that the traction member 34 is driven by the auxiliary gear 32 to be moved backwardly. Meanwhile, the concave structure 343 of the traction member 34 is detached from the convex structure 213 of the sidewall 211. Consequently, the paper pick-up arm 21 will be moved downwardly to the paper pick-up position to pick up the paper.

From the above description, the paper-stopping mechanism of the automatic document feeder of the present invention is capable of stopping the paper in response to the action of the paper pick-up arm. That is, when the paper pick-up arm is in the standby position, the paper-stopping mechanism can hinder the paper from entering the paper-feeding channel.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper-stopping mechanism of an automatic document feeder, said automatic document feeder having a paper pick-up arm for feeding a paper, said paper-stopping mechanism comprising:

an upper cover, wherein said paper pick-up arm is disposed on said upper cover;

an auxiliary gear disposed on said paper pick-up arm, wherein during said paper pick-up arm is moved upwardly to a standby position, said auxiliary gear is rotated in a first direction, wherein during said paper pick-up arm is moved downwardly to a paper pick-up position, said auxiliary gear is rotated in a second direction;

a paper-stopping arm pivotally coupled with said upper cover wherein said paper-stopping arm further comprises an elongated slot and a paper-stopping slice, wherein said transverse rod is penetrated through said elongated slot; and a traction member disposed on said upper cover, wherein said traction member is stayed in a first position when said paper pick-up arm is in said standby position, wherein said traction member comprises:

a rack engaged with said auxiliary gear, wherein upon rotation of said auxiliary gear in said first direction, said traction member is moved to said first position, wherein upon rotation of said auxiliary gear in said second direction, said traction member is moved to a second position; and a transverse rod, wherein when said traction member is in said first position, said transverse rod is sustained against said paper-stopping arm, so that said paper-stopping arm is stayed in a paper-stopping position, wherein when traction member is in said second position, said paper-stopping arm is raised by said transverse rod, so that said paper-stopping arm is detached from said paper-stopping position.

2. The paper-stopping mechanism according to claim 1 wherein said first direction is an anti-clockwise direction, and said second direction is a clockwise direction.

3. The paper-stopping mechanism according to claim 1 wherein said traction member is integrally formed.

4. The paper-stopping mechanism according to claim 1 wherein said auxiliary gear is penetrated through a sidewall of said paper pick-up arm, and engaged with a transmission gear of said paper pick-up arm.

5. The paper-stopping mechanism according to claim 1 wherein said traction member has a concave structure, and said paper pick-up arm has a convex structure corresponding to said concave structure.

6. The paper-stopping mechanism according to claim 5 wherein during said paper pick-up arm is moved upwardly to said standby position, said auxiliary gear is engaged with said rack to move said traction member to said first position, so that said concave structure is engaged with said convex structure and said paper pick-up arm is stayed in said standby position.

7. The paper-stopping mechanism according to claim 5 wherein during said paper pick-up arm is moved downwardly to said paper pick-up position, said traction member is driven by said auxiliary gear to be moved to said second position, so that said concave structure is detached from said convex structure and said paper pick-up arm is moved downwardly to said paper pick-up position.

* * * * *